US006276420B1

(12) United States Patent
Lanthier

(10) Patent No.: US 6,276,420 B1
(45) **Date of Patent: *Aug. 21, 2001**

(54) COATED CORRUGATOR BELT

(75) Inventor: Joseph D. Lanthier, Cohoes, NY (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/061,970

(22) Filed: Apr. 17, 1998

(51) Int. Cl.[7] ..... B31F 1/20

(52) U.S. Cl. ..... 156/462; 156/470; 442/101; 474/268

(58) Field of Search ..... 428/222, 316.6; 442/225, 227, 280, 281, 277, 248, 249, 250, 251, 252, 253, 254, 255, 101; 28/110; 162/358.2, 900, 902; 156/462, 470; 34/660, 236; 198/626.1, 844.1, 957, 846, 847; 226/96, 172; 427/412; 474/268, 271

(56) References Cited

U.S. PATENT DOCUMENTS

| | | | | |
|---|---|---|---|---|
| 3,368,933 | * | 2/1968 | Wicker | 156/498 |
| 4,418,726 | * | 12/1983 | Josef et al. | 139/383 |
| 4,526,637 | * | 7/1985 | Long | 156/137 |
| 4,675,229 | * | 6/1987 | Westhead | 428/222 |
| 5,050,646 | * | 9/1991 | Fry | 139/383 |
| 5,298,124 | * | 3/1994 | Eklund et al. | 162/306 |
| 5,436,045 | * | 7/1995 | Fruitman | 428/36.1 |
| 5,785,621 | * | 7/1998 | Birzele | 474/267 |

* cited by examiner

*Primary Examiner*—Sam Chuan Yao
*Assistant Examiner*—Gladys Piazza
(74) *Attorney, Agent, or Firm*—Pitney, Hardin, Kipp & Szuch, LLP

(57) ABSTRACT

A corrugator belt for a corrugator machine includes a base having two sides. One of the two sides is the face side of the corrugator belt when the belt is in the form of an endless loop on a corrugator machine. A layer of polymeric resin material is coated onto the face side of the base. The polymeric resin material provides the corrugator belt with an increased coefficient of friction relative to corrugated board, enabling the belt to pull corrugated board more readily through a corrugator machine.

8 Claims, 3 Drawing Sheets

COATED CORRUGATOR BELT

BACKGROUND OF THE INVENTION

1. Field of the Invention

The present invention relates to the manufacture of corrugated paper board, and, more specifically, to the so-called corrugator belts which run on the corrugator machines used to manufacture that variety of paper board.

2. Description of the Prior Art

The manufacture of corrugated paper board, or box board, on corrugator machines is well-known in the art. On such machines, corrugator belts pull a web of corrugated board first through a heating zone, where an adhesive used to bond layers of the web together is dried or cured, and then through a cooling zone. Frictional forces between the corrugator belt, specifically the face, or board, side thereof, and the web are primarily responsible for pulling the latter through the machine.

Corrugator belts should be strong and durable, and should have good dimensional stability under the conditions of tension and high temperature encountered on the machine. The belts must also be comparatively flexible in the longitudinal, or machine, direction, while having sufficient rigidity in the cross-machine direction to enable them to be guided around their endless paths. Traditionally, it has also been desirable for the belts to have porosities sufficient to permit vapor to pass freely therethrough, while being sufficiently incompatible with moisture to avoid the adsorption of condensed vapor which might rewet the surfaces of the corrugated product.

As implied in the preceding paragraph, a corrugator belt takes the form of an endless loop when installed on a corrugator machine. In such form, the corrugator belt has a face, or board, side, which is the outside of the endless loop, and a back side, which is the inside of the endless loop. Frictional forces between the back side and the drive rolls of the corrugator machine move the corrugator belt, while frictional forces between the face side and the web of corrugated board pull the web through the machine.

Corrugator belts are generally flat-woven, multi-layered fabrics, each of which is trimmed in the lengthwise and widthwise directions to a length and width appropriate for the corrugator machine on which it is to be installed. The ends of the fabrics are provided with seaming means, so that they may be joined to one another with a lacing cable when the corrugator belt is being installed on a corrugator machine.

In a typical corrugator machine, the heating zone comprises a series of hot plates across which the web of corrugated board is pulled by the corrugator belt. A plurality of weighted rollers within the endless loop formed by the corrugator belt press the corrugator belt toward the hot plates, so that the corrugator belt may pull the web across the hot plates under a selected amount of pressure. The weighted rollers ensure that the web will be firmly pressed against the hot plates, and that frictional forces between the corrugator belt and the web will be sufficiently large to enable the belt to pull the web.

In a new generation of corrugator machines, the weighted rollers have been replaced with air bearings, which direct a high-velocity flow of air against the back side of the corrugator belt and toward the hot plates to force the corrugator belt toward the hot plates. In order to prevent the high-velocity air flow from passing through the corrugator belt, which would cause the belt to lift from the web of corrugated board and allow the belt to slip in the running direction relative to the web, leading to poor contact between the web and the hot plates and ultimately to poor, non-uniform bonding in the laminated corrugated board product, the back sides of the corrugator belts used on machines having air bearings have a layer of polymeric resin material, which is impermeable and seals the corrugator belt to prevent air from passing therethrough.

In an even newer generation of corrugator machines, the corrugator belt which presses the web of corrugated board against the hot plates has been eliminated to avoid such belt-related problems as seam mark, edge crush, edge bonding and warping. Instead, a pair of belts downstream from the heating zone in a cooling zone sandwich the web of corrugated board from above and below and pull it through the heating zone.

It has been found that the corrugator belts currently available have not worked satisfactorily when installed on this latest generation of corrugator machines. A present, corrugator belts have a needled or woven surface with a coefficient of friction, relative to corrugated board, in a range from 0.15 to 0.20. As the corrugator belts contact the web of corrugated board only in the cooling zone over a total area much less than that characterizing older machines, current belts have not been able to generate frictional forces large enough to pull the web through the corrugator machine.

Clearly, corrugator machines of this most recent type require corrugator belts whose surfaces have a greater coefficient of friction, relative to corrugated board, than those currently available, so that they will be able to generate the required frictional forces. This need is met by the present invention.

SUMMARY OF THE INVENTION

Accordingly, the present invention is a corrugator belt for a corrugator machine. The belt comprises a base having two sides, one of the two sides being the face side of the corrugator belt when the corrugator belt is in the form of an endless loop on a corrugator machine. A layer of polymeric resin material is coated onto the face side of the base. The polymeric resin material provides the corrugator belt with an increased coefficient of friction relative to corrugated board to enable the corrugator belt to pull corrugated board more readily through a corrugator machine.

In a preferred embodiment, the base is a multi-layer base fabric. The multi-layer base fabric has a plurality of layers of weft yarns and a plurality of systems of warp yarns, each of the systems weaving between the weft yarns of two of the plurality of layers. All of the plurality of layers of weft yarns are joined together by the systems of warp yarns.

Alternatively, as those of ordinary skill in the art will readily appreciate, the corrugator belt may have a base in the form of a spiral coil carrier instead of a woven structure. Spiral coil carriers are shown in U.S. Pat. Nos. 4,395,308; 4,662,994; and 4,675,229, the teachings of all three of which are incorporated herein by reference. Spiral coil carriers are well-known to those of ordinary skill in the arts of papermaker's dryer fabrics and corrugator belts, and include a plurality of hinge yarns, all of the hinge yarns extending in a common direction, and a plurality of spiral coils disposed in a common plane in a side-by-side relationship, each of the coils extending in the common direction. Adjacent coils of the spirals are intermeshed and held together in intermeshing relationship by at least one of the hinge yarns. The endless spiral coil carrier thereby obtained has two sides. As above, a layer of a polymeric resin material is on the face side.

The present invention will now be described in more complete detail with frequent reference being made to the figures identified as follows.

DETAILED DESCRIPTION OF THE PREFERRED EMBODIMENTS

Figure 1:
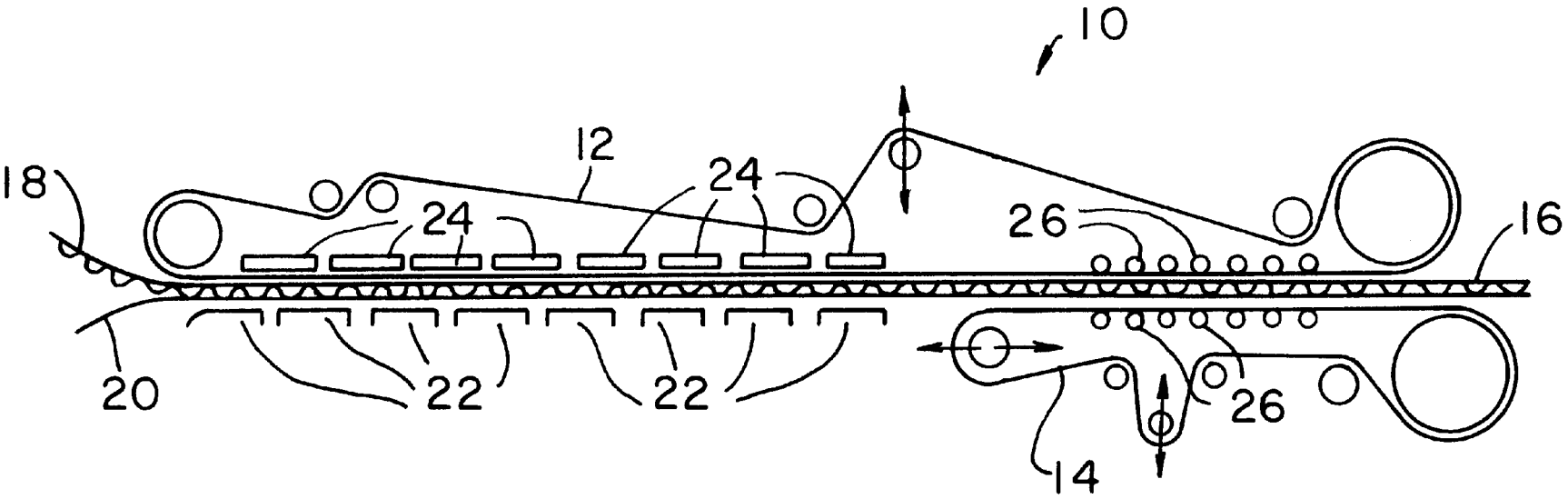
PRIOR ART FIG. 1
FIG. 1 is a schematic view of a conventional corrugator machine.

Turning now to FIG. 1, a conventional corrugator machine 10 has an upper corrugator belt 12 and a lower corrugator belt 14 which together pull a corrugated paper product 16 therethrough. The corrugated paper product 16 includes a corrugated layer 18 and an uncorrugated layer 20, which are to be joined to one another in the corrugator machine 10 by means of a suitable adhesive. The corrugated layer 18 and the uncorrugated layer 20 are brought together at one end of the machine 10 and are pulled by the upper corrugator belt 12 across a series of hot plates 22 to dry and/or to cure the adhesive which bonds the paper layers together.

The corrugator machine 10 includes a plurality of air bearings 24 from which high-velocity air flows are directed against the inside of the upper corrugator belt 12 toward the hot plates 22. The air bearings 24 thereby apply pressure from within the endless loop formed by upper corrugator belt 12, so that the upper corrugator belt 12 may pull the corrugated paper product 16 across the series of hot plates 22 at the same time as it pushes the corrugated paper product 16 against the series of hot plates 22. It should be understood by the reader that the upper corrugator belt 12, the corrugated paper product 16 and the series of hot plates 22 are separated from one another for the sake of clarity in FIG. 1.

As noted above, because corrugator machine 10 includes air bearings 24, upper corrugator belt 12 has a layer of polymeric resin material on its inner surface, that is, on the inner surface of the endless loop formed thereby on the corrugator machine. The layer of polymeric resin material renders the upper corrugator belt 12 impermeable, so that the flow of air from air bearings 24 cannot pass therethrough. Alternatively, weighted rollers may be used in place of air bearings 24. In such case, the upper corrugator belt 12 will not require a layer of polymeric resin material on its inner surface.

In any case, after passing over the series of hot plates 22, the upper corrugator belt 12 and the lower corrugated belt 14 together pull the corrugated paper product 16 between them, maintaining the speed of the process operation and cooling the corrugated paper product 16. As may be observed, weighted rollers 26 may be deployed to apply pressure from within the endless loops formed by the upper corrugator belt 12 and the lower corrugator belt 14 toward one another, so that the corrugated paper product 16 may be held therebetween with some suitable degree of firmness. Air bearings may be used instead of the weighted rollers 26 within upper corrugator belt 12, provided that it has a layer of polymeric resin material on the inner surface of the endless loop formed thereby on the corrugator machine to make it impermeable to the air flow.

Figure 2:
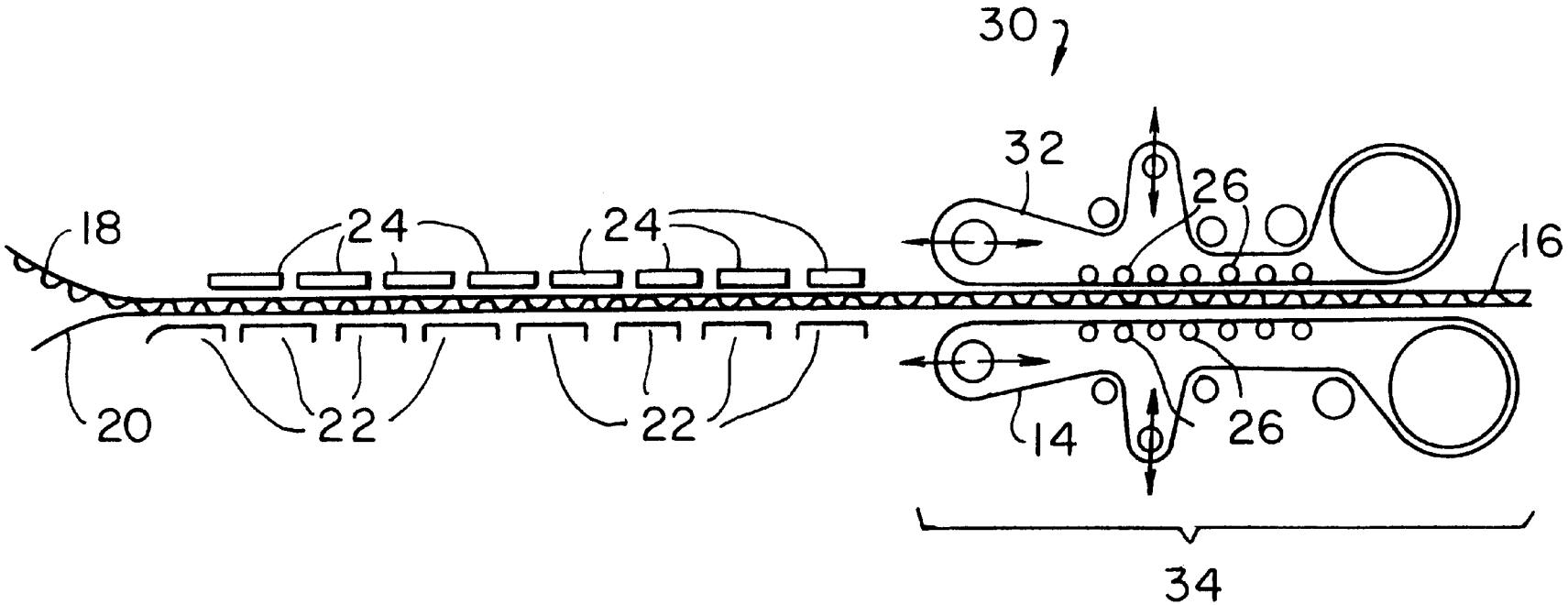
PRIOR ART FIG. 2
FIG. 2 is a schematic view of a corrugator machine of a more modern design.

FIG. 2 shows a corrugator machine 30 of the latest design, wherein upper corrugator belt 12 has been eliminated and replaced with a much shorter upper corrugator belt 32. Upper corrugator belt 32 does not pass across hot plates 22. Instead, it is disposed opposite the lower corrugator belt 14 downstream from hot plates 22 in what may be referred to as cooling, or pulling, zone 34.

In this new variety of corrugator machine 30, weighthed steel shoes or flows of high-velocity air from air bearings 24 alone push the corrugated paper product 16 against the series of hot plates 22. The upper corrugator belt 32 and the lower corrugator belt 14, working in tandem downstream from the hot plates 22, pull the corrugated paper product 16 through the corrugator machine 30. Weighted rollers 26 apply pressure from within the endless loops formed by the upper corrugator belt 32 and the lower corrugator belt 14 toward one another, so that the corrugated paper product 16 may be held therebetween with some suitable degree of firmness. Air bearings or weighted steel shoes may be used instead of weighted rollers 26 within upper corrugator belt 32.

As will readily be noted by comparing FIGS. 1 and 2, upper corrugator belt 32 contacts corrugated paper product 16 over a much shorter distance than does corrugator belt 16, yet must still generate forces of friction against corrugated paper product 16 sufficient to pull it through the corrugator machine 30. As noted at the outset, corrugator belts heretofore available have not been able to generate the required frictional forces.

The corrugator belt of the present invention is designed for use as either an upper corrugator belt 32 or as a lower corrugator belt 14 on a corrugator machine 32 of the variety shown in FIG. 2. Preferably, both the upper and lower corrugator belts 32,14 would be corrugator belts of the present invention. The corrugator belt of the present invention has an impermeable coating of a polymeric resin material on the outer surface of the endless loop formed thereby when the corrugator belt is on a corrugator machine. The coating enables the belt to generate the frictional forces required to pull the corrugated paper product 16 through a corrugator machine of the variety shown in FIG. 2.

Figure 3:
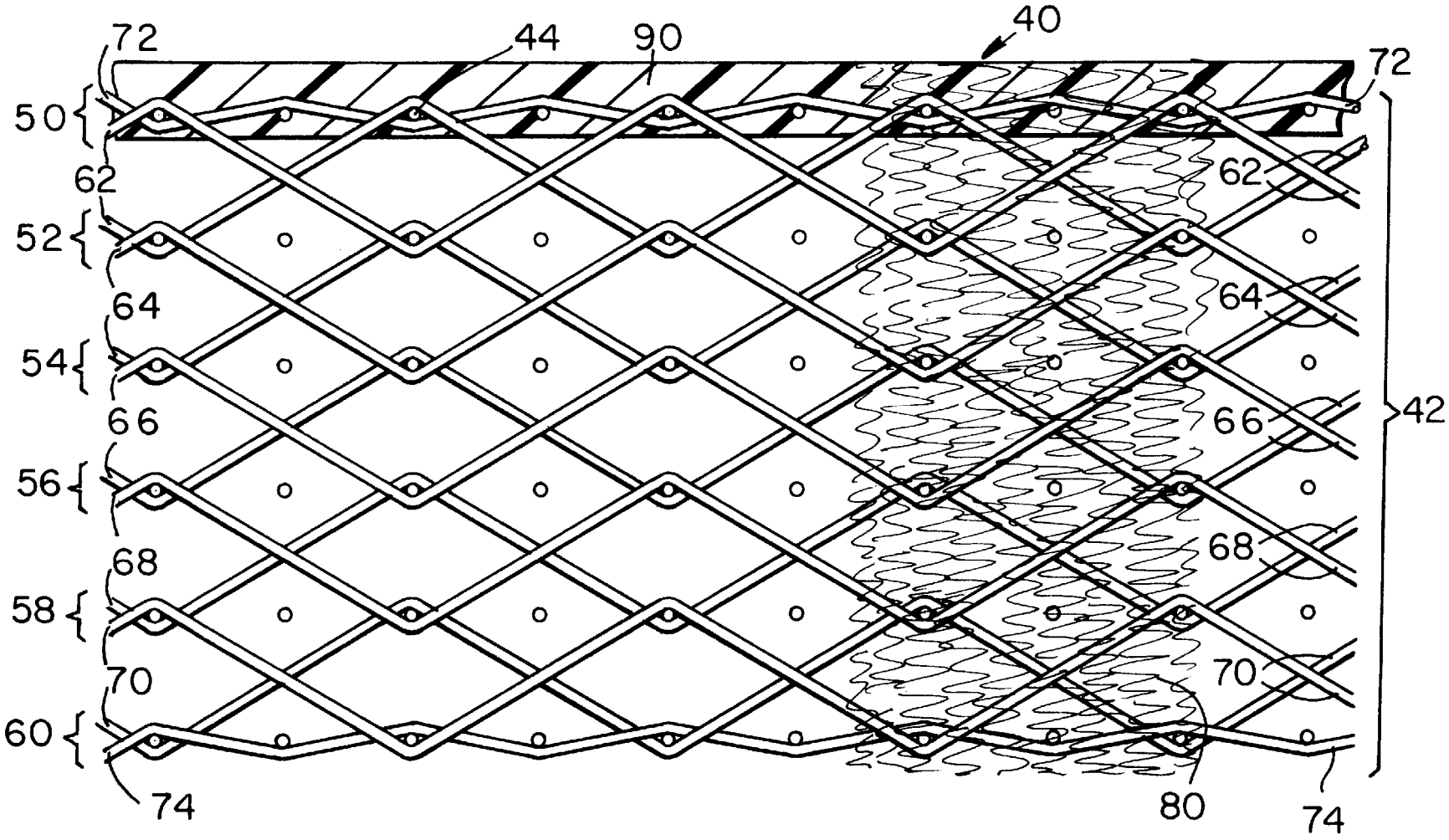
FIG. 3 is a cross-sectional view, taken in the longitudinal or warpwise direction, of a preferred embodiment of the corrugator belt of the present invention.

A cross-sectional view of a preferred embodiment of the corrugator belt of the present invention is presented in FIG. 3. The cross-sectional view has been taken in the longitudinal or warpwise direction and shows the weft or filling yarns in cross section. Because the embodiment shown is flat-woven, the warp yarns in its base fabric are oriented in the machine direction with respect to the corrugator machine on which it is installed.

As depicted in FIG. 3, the corrugator belt 40 includes a multi-layer base fabric 42 comprising a plurality of layers of weft or filling yarns, each of which layers is connected to those adjacent thereto by a system of warp yarns.

With specific reference to the embodiment illustrated in FIG. 3, the multi-layer base fabric 42 comprises six layers of weft, or filling, yarns 44, wherein the weft, or filling, yarns 44 in each layer are disposed in a vertically stacked relationship with respect to those in other layers.

The first layer 50 and the second layer 52 of weft yarns 44 are joined or woven to each other by a first system of warp yarns 62. In like manner, the second layer 52 and the third layer 54 are woven together by a second system of warp yarns 64; the third layer 54 and the fourth layer 56 are woven together by a third system of warp yarns 66; the fourth layer 56 and the fifth layer 58 are woven together by a fourth system of warp yarns 68; and, finally, the fifth layer 58 and the sixth layer 60 are woven together by a fifth system of warp yarns 70.

Additional warp yarns 72 weave with the weft yarns 44 of the first layer 50 in a plain weave, and, likewise, additional warp yarns 74 weave with the weft yarns 44 of the sixth layer 60, also in a plain weave, to fill out the surfaces of the base fabric 42.

The weave pattern shown in FIG. 3, however, should be understood to be an example of the multi-layer weaves which may be employed in the practice of the present invention and should not be construed as limiting such practice to the specific weave shown. In like manner, the impermeable corrugator belt of the present invention may be manufactured using a base in the form of a spiral coil carrier, as described above, rather than a base like multi-layer base fabric 42.

The base fabric 42 may be woven from warp and filling yarns comprising yarns of any of the varieties used in the manufacture of papermachine clothing and industrial process fabrics. That is to say, the base fabric 42 may include monofilament, plied monofilament, or multifilament yarns of any of the synthetic polymeric resins used by those skilled in the art, such as polyester, polyamide, and polyethylene or polybutylene terephthalate. Spun yarns of natural or synthetic staple fibers may also be included, so long as they are capable of withstanding the temperatures characteristic of corrugator machines. Spun polyester, polyamide or polyaramid yarns are but a few examples.

One or both sides of the base fabric 42 may be needled with a web 80 of staple fiber material in such a manner that the fibers are driven into the structure of the base fabric 42. One or more layers of staple fiber material may be needled into one or both sides of the base fabric 42, and the web 80 may extend partially or completely through the base fabric 42.

The webs of staple fiber material used for this purpose may be of polyester, polypropylene, polyamide or acrylic fibers. For the sake of clarity, the web 80 is included in only a portion of FIG. 3.

Where a spiral coil carrier of the variety described above is used instead of base fabric 42, one or both of its two sides may be needled with a web of staple fiber material in such a manner that the fibers are driven into its structure. One or more layers of staple fiber material may be needled into one or both sides of the spiral coil carrier, and the web may extend partially or completely through the spiral coil carrier.

Referring again to FIG. 3, one side of the base fabric 42 is coated with a layer 90 of polymeric resin material. In actual use on a corrugator machine, when the corrugator belt 40 has been placed thereon in the form of an endless loop, the layer 90 of polymeric resin material is disposed on the outside of the endless-loop form thereof, that is, on the face side of the corrugator belt 40. The layer 90 of polymeric resin material renders the corrugator belt 40 impermeable.

Similarly, where a spiral coil carrier is used instead of a base fabric 42, one of its two sides is coated with a layer of polymeric resin material. In the actual use of such a corrugator belt on a corrugator machine, the layer of polymeric resin material is disposed on the outside of the endless-loop form thereof.

The layer 90 of polymeric resin material raises the coefficient of friction of the outer surface of the corrugator belt 40, relative to corrugated board, to a value in the range from 0.8 to 0.9, enabling the belt to generate frictional forces against the corrugated board sufficient to pull it through the corrugator machine 30.

The polymeric resin material used to provide layer 90 preferably includes polyurethane. The polyurethane may be applied in the form of an aqueous dispersion including a filler, such as clay.

Modifications to the above would be obvious to those of ordinary skill in the art, yet would not bring the invention so modified beyond the scope of the appended claims.

What is claimed is:

1. In a corrugator machine having a cooling zone located downstream from a heating zone, wherein a corrugator belt, disposed in said cooling zone, pulls corrugated board being manufactured on said corrugator machine through said heating zone, said heating zone not having a corrugator belt, the improvement comprising a coated corrugator belt in said cooling zone, said coated corrugator belt having:

a base having two sides, one of said two sides being a face side when said coated corrugator belt is in the form of an endless loop on said corrugator machine; and an impermeable coating of a polymeric resin material on said face side of said base, said impermeable coating of polymeric resin material forming an impermeable layer on said face side of said base, rendering said coated corrugator belt impermeable to air and providing said coated corrugator belt with an increased coefficient of friction relative to said corrugated board to enable said coated corrugator belt to pull said corrugated board more readily through said corrugator machine.

2. The improvement as claimed in claim 1 wherein said base is a multi-layer base fabric having a plurality of layers of weft yarns and a plurality of systems of warp yarns, each of said systems weaving between said weft yarns of two adjacent layers of said plurality of layers, so that all of said plurality of layers of weft yarns are joined together into said base fabric.

3. The improvement as claimed in claim 1 wherein said base is a spiral coil carrier including a plurality of hinge yarns, all of said hinge yarns extending in a common direction, and a plurality of spiral coils disposed in a common plane in a side-by-side relationship, each of said spiral coils extending in a common direction and adjacent spiral coils being intermeshed with one another and held together in intermeshing relationship by at least one of said hinge yarns.

4. The improvement as claimed in claim 1 further comprising a web of staple fiber material needled into at least one side of said base.

5. The improvement as claimed in claim 1 wherein said coating includes polyurethane.

6. The improvement as claimed in claim 5 wherein said coating is applied in the form of an aqueous dispersion.

7. The improvement as claimed in claim 6 wherein said aqueous dispersion further comprises a filler.

8. The improvement as claimed in claim 7 wherein said filler is clay.

* * * * *